United States Patent [19]

Tokuhiro et al.

[11] Patent Number: 5,046,910

[45] Date of Patent: Sep. 10, 1991

[54] MAIN BODY STRUCTURE FOR UNDERGROUND PARKING LOT AND UNDERGROUND PARKING LOT USING THE STRUCTURE

[75] Inventors: Tomoya Tokuhiro; Teruo Hatano; Koshin Kikuchi; Shinichi Ozaki, all of Tokyo, Japan

[73] Assignee: Shimizu Construction Co., Ltd., Tokyo, Japan

[21] Appl. No.: 497,604

[22] Filed: Mar. 22, 1990

[30] Foreign Application Priority Data

Mar. 23, 1989 [JP] Japan ..... 1-71159

[51] Int. Cl.[5] ..... E04H 6/12

[52] U.S. Cl. ..... 414/261; 52/30; 52/169.6; 52/245

[58] Field of Search ..... 414/261, 263, 264; 52/29, 30, 169.6, 245

[56] References Cited

U.S. PATENT DOCUMENTS

| | | | |
|---|---|---|---|
| 1,966,165 | 7/1934 | Clyde | 414/263 |
| 2,691,448 | 10/1954 | Lontz | 414/263 X |
| 3,132,752 | 5/1964 | Bianca | 414/261 X |
| 3,380,207 | 4/1968 | Wilson | 52/30 X |
| 4,023,687 | 5/1977 | Salloum | 414/263 X |
| 4,264,257 | 4/1981 | Saurwein | 414/263 X |
| 4,850,784 | 7/1989 | Salloum | 414/261 X |

FOREIGN PATENT DOCUMENTS

| | | | |
|---|---|---|---|
| 511304 | 5/1952 | Belgium | 52/30 |
| 1951724 | 8/1970 | Fed. Rep. of Germany | 52/30 |
| 1195126 | 11/1959 | France | 52/30 |
| 1199682 | 12/1959 | France | 52/30 |
| 340336 | 9/1959 | Switzerland | 414/264 |
| 509601 | 7/1939 | United Kingdom . | |
| 750741 | 6/1956 | United Kingdom . | |
| 829723 | 3/1960 | United Kingdom . | |

*Primary Examiner*—David A. Bucci

*Attorney, Agent, or Firm*—Oblon, Spivak, McClelland, Maier & Neustadt

[57] ABSTRACT

A main body structure for an underground parking lot has an outer wall formed in a substantially cylindrical shape to define a space under the ground. A radial structural body is formed in and connected to the outer wall to support the same on the inside thereof and to divide the space within the outer wall into plural vehicle accommodation spaces. The underground parking lot constructed with this main body structure includes vehicle accommodation mechanisms which are arranged in the respective vehicle accommodation spaces.

7 Claims, 5 Drawing Sheets

MAIN BODY STRUCTURE FOR UNDERGROUND PARKING LOT AND UNDERGROUND PARKING LOT USING THE STRUCTURE

BACKGROUND OF THE INVENTION

The present invention relates to a main body structure for an underground parking lot and the underground parking lot constructed by using the structure, in which structure the outer periphery of a main body is formed in a substantially cylindrical shape.

In recent years, in urban areas, such a serious problem arises as to get a site for a building. Particularly, it is getting in an extremely difficult situation to secure a space for parking cars.

For improving the accommodation or parking capacity for vehicles of a small site, it is effective to employ such a structure which is capable of accommodating vehicles in three dimensions. For this end, as is well known, there have been provided a mechanical type parking tower which has an elevator mechanism or the like to accommodate plural cars in a three-dimensional manner, a self-traveling type three-dimensional parking lot which has plural floors constructed on the ground and ramps for interconnecting the floors and in which drivers themselves drive their vehicles to transport the same to any floor, an underground parking lot which is constructed in three dimensions by utilizing the underground of a site for a building, or the like.

Among the above three-dimensional parking lots, the underground type particularly surpasses in making effective use of the site, because it utilizes the underground of a building and requires no new site for the parking lot. Further, as this type parking lot, so to say, integrally exists within the building which has residential floors, when users of this parking lot have somethings to do in this building, they can shorten time for movement. This is particularly convenient for them.

In constructing the underground type parking lot, however, problems arise as follows.

Namely, a conventional underground parking lot has generally been designed to have a main body formed in a rectangular shape in cross section. However, in the underground parking lot thus designed in the rectangular shape, according as its depth in the ground increases, a large sectional force acts over its structural body due to an earth pressure of the ground, a water pressure and so on. When constructing this type parking lot, therefore, it is required to provide timbering, struts or the like, taking time and labor and increasing cost. Further, even when no timbering is used, it is necessary to use a caisson type or an ultra thick wall type underground continuous wall. Thus, the underground parking lot has many executive restrictions in the term of working, the cost of construction and so forth.

Moreover, since the conventional underground parking lot of the rectangular shape has the difficulty in being made large in cross section as described above, there are many cases where the underground parking lot is small in plan size as compared with the building which is to be constructed on the parking lot. Therefore, it is not attainable to use the site to the maximum extent, and in addition, it is still necessary to provide piles or the like for supporting the building on the outside of the underground parking lot.

SUMMARY OF THE INVENTION

In view of the above circumstances, it is an object of the invention to provide a main body structure for an underground parking lot, with which the parking lot can be made large in cross section to effectively use a site for building while sufficiently fulfilling its function as a parking lot.

Another object of the invention is to provide a main body structure for an underground parking lot, which has a positive function of serving as the foundation of a building and which is simplified in structure to rationalize the construction of the parking lot.

It is still another object of the invention to provide an underground parking lot which can be constructed by using the above main body and has a high efficiency of accommodation for vehicles.

According to an aspect of the invention, there is provided a main body structure for an underground parking lot which comprises an outer wall formed in a substantially cylindrical shape for defining a space under ground, and a radial structural body formed within and connected to the outer wall for dividing the space thereof into plural vehicle accommodation spaces.

In this structure, the cross section of the main body to be constructed under the ground, more specifically, that of the outer wall is shaped in a circle, in which almost no bending moment and shearing force is produced and only axial force is produced. The outer wall thus formed in a substantially cylindrical shape exhibits excellent durability for withstanding earth and water pressures of the ground. Therefore, the plan size of the main body can be increased, while there is no need to thicken the outer wall more than required. This makes it possible to effectively use a site and enlarge the inside space of the outer wall. Further, the radial structural body in the cylindrical outer wall serves as timbering for the outer wall with respect to an external force horizontally acting thereon, and functions in cooperation with the outer wall as foundation piles for a ground structure. Thus, the construction of the main body of the underground parking lot involves all or most of the construction of a foundation for the ground structure or building, realizing an extremely rational process of construction. The main body constituted by combining the cylindrical outer wall with the radial body is very simple in structure and, therefore, easy to construct.

According to another aspect of the invention, there is provided an underground parking lot which comprises an outer wall formed in a substantially cylindrical shape for defining a space under ground, a radial structural body formed within and connected to the outer wall for dividing the space thereof into plural vehicle accommodation spaces, and vehicle accommodation mechanisms respectively provided in the vehicle accommodation spaces, each vehicle accommodation mechanism including a lift for going up and down with a vehicle loaded thereon, a well for the lift, and plural vehicle receiving stands vertically arrayed close to the lift well.

In this underground parking lot, the main body having the excellent function as described above can effectively be used. Further, plural vehicle receiving stands, which are vertically arrayed, are provided in each vehicle accommodation space, so that a high efficiency of accommodation for vehicles is attainable. More than two rows of the vehicle receiving stands may be provided with respective to each vehicle accommodation space.

Preferably, three rows of the vehicle receiving stands are provided for every lift well. With such provision, good use of the respective vehicle accommodation spaces defined by the main body can effectively be made. Further, it is preferable that a first floor is formed over the vehicle accommodation spaces and the respective lift wells open in the first floor to form inlets for taking in and delivering vehicles. The inlets corresponding to the respective vehicle accommodation mechanisms are simply opened in the first floor and, thus, the structure for taking in and delivering vehicles can be made very simple.

DESCRIPTION OF THE EMBODIMENTS

Description will be made hereinafter on the embodiments of the invention with reference to the accompanying drawings.

Figure 1:
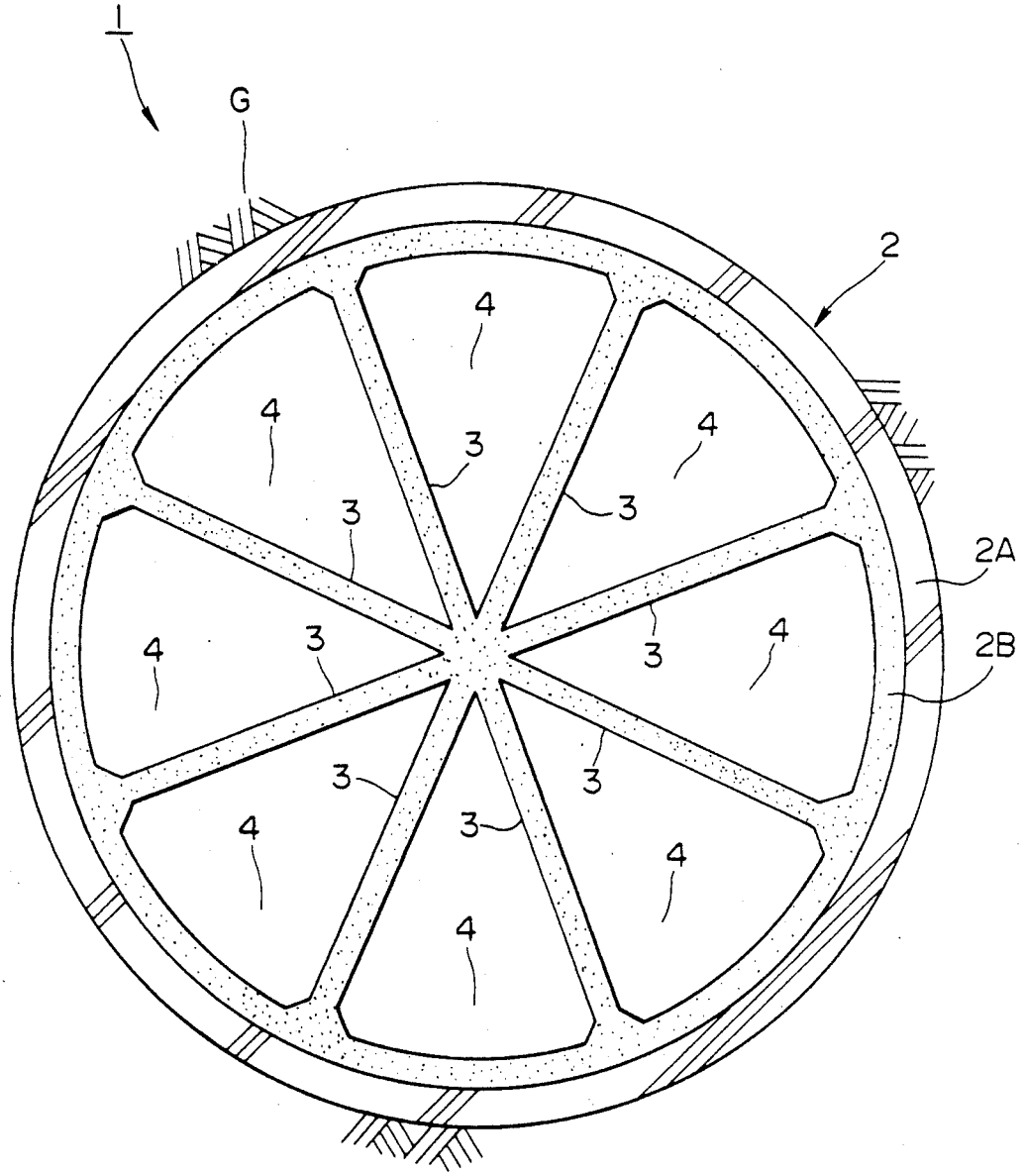
FIG. 1 is a horizontal sectional view showing the main body structure of the underground parking lot according to a first embodiment of the invention.

FIG. 1 is a horizontal sectional view showing an example of the main body structure of the underground parking lot according to the invention.

The main body 1 of this underground parking lot comprises an outer wall 2 which is formed in a substantially cylindrical shape in the ground G, and radial partition walls 3 which are formed within the cylindrical body of the outer wall 2 and constitute a radial structural body. The respective partition walls 3 radially extend from the axial center of the cylindrical body to the outer wall 2 to divide a space within the outer wall 2 along the circumferential direction thereof into a plurality of vehicle accommodation spaces 4 which are the same in shape.

In this embodiment, the outer wall 2 is constituted by a underground continuous wall 2A and a wall 2B which is formed later to be integrally fixed to the inner side of the underground continuous wall 2A. Herein, the outer wall 2 is intended to have a diameter of, for instance, thirty-odd meters and be formed over a depth of 3Q m to 5Q m from the ground surface.

The radial partition walls 3, in this embodiment, are eight in number which are radially formed from the axial center of the outer wall 2 to the wall 2B thereof as shown in the drawing. With this formation, the space within the outer wall 2 is divided into eight fan-shaped vehicle accommodation spaces 4.

The main body 1 having the above structure is constructed as a foundation for a structure which is to be constructed on the ground. The ground structure or building, although not shown in the drawing, is continuously constructed on the upper portion of the main body 1, namely the upper portions of the outer wall 2 and the radial partition walls 3.

The construction of the main body 1 having the above structure is carried out, for instance, in the following procedure.

First, according to the method of underground continuous wall, the underground continuous wall 2A is constructed in the ground G, which is formed in a circle to be into the substantially cylindrical shape.

The underground continuous wall method, as is well known, is such that a continuous groove-like hole is dug in the ground while the wall of the hole is stabilized by means of a stabilizing liquid and, then, a continuous ferro-concrete wall is formed in the hole. According to this underground continuous wall method, usually, the body of the wall is divided into plural units along a direction in which the wall body is to be formed, and is constructed at every unit. When viewing each of these units, the shape of the unit is rectangular in horizontal cross section. Accordingly, strictly speaking, the outer wall 2 which is formed by successively connecting these units is polygonal in horizontal cross section. However, when the diameter of the outer wall is sufficiently large as is in the case of the main body 1 of the embodiment, it can be regarded as being approximately cylindrical.

When the underground continuous wall 2A has been constructed in the cylindrical shape, then, the portion of the ground G enclosed by the underground continuous wall 2A is dug. At this time, as the underground continuous wall 2A is in the cylindrical shape, or a circle in horizontal cross section, the wall exhibits extremely excellent durability for withstanding earth and water pressures of the surrounding ground G as compared with the wall of a rectangular cross section. When digging the ground inside the continuous wall, therefore, it is unnecessary to provide timbering, struts and the like, so that the efficiency of the digging work itself can be improved and, in addition, material costs and assembly and disassembly processes required for the timbering and the like can be saved.

When the ground inside the underground continuous wall 2A has been dug, concrete is laid on the bottom of the thus dug hole to form a bottom bed which is not shown in the drawing.

Then, after the formation of the bottom bed, the post-formed wall 2B and the radial partition walls g can be constructed one after another to extend upward from the bottom bed. The post-formed wall 2B and the underground continuous wall 2A are united with each other into one body by means of doweling bars or the like. That is, in this embodiment, the underground continuous wall 2A and the post-formed wall 2B constitute the outer wall 2 of the main body 1. Incidentally, the post-formed wall 2B is constructed primarily for forming the interior face of the underground continuous wall 2A.

Once the main body 1 of the underground parking lot to be constructed under the ground of a ground structure or building is constructed of the above structure, not only the cylinder-shaped outer wall 2 but also the respective radial partition walls 3 integrally formed in the longitudinal directions thereof effectively function as foundation piles for the ground structure. Therefore, the construction of the foundation for the ground structure is completed simultaneously with the construction of the main body 1 for the parking lot, realizing an extremely effective process of construction.

Further, the main body 1, as the outer wall 2 thereof for directly withstanding earth and water pressures of the ground is in the cylindrical shape, exhibits excellent durability to the earth and water pressures, so that the cross section or plan size of the main body can be enlarged. Accordingly, the main body 1 can be the same in plan size as the ground structure, and it is possible to use the area of the site for the ground structure to the maximum extent and completely eliminate, or reduce as little as possible, the construction of such an additional foundation as piles separately provided for supporting the ground structure or the like.

Additionally, as the outer wall 2 is excellent in durability, the thickness thereof can be reduced to enlarge the internal space for accommodating vehicles.

Furthermore, although the cylindrical outer wall 2 itself has sufficient strength for withstanding the earth and water pressures of the ground G, the main body 1 of the above structure further has the radial partition walls 3 formed inside the outer wall 2. The radial partition walls g serves to support the outer wall 2 on the inside thereof so as to provide the very strong structure with respect to an external force which horizontally acts on the outer wall 2.

Moreover, the outer wall 2 can be formed according to the underground continuous wall method as described above, and the radial partition walls 3 can be formed without taking time and labor owing to their simplicity in shape. The main body 1 as a whole, therefore, can be constructed within a very short term of works.

Figure 2:
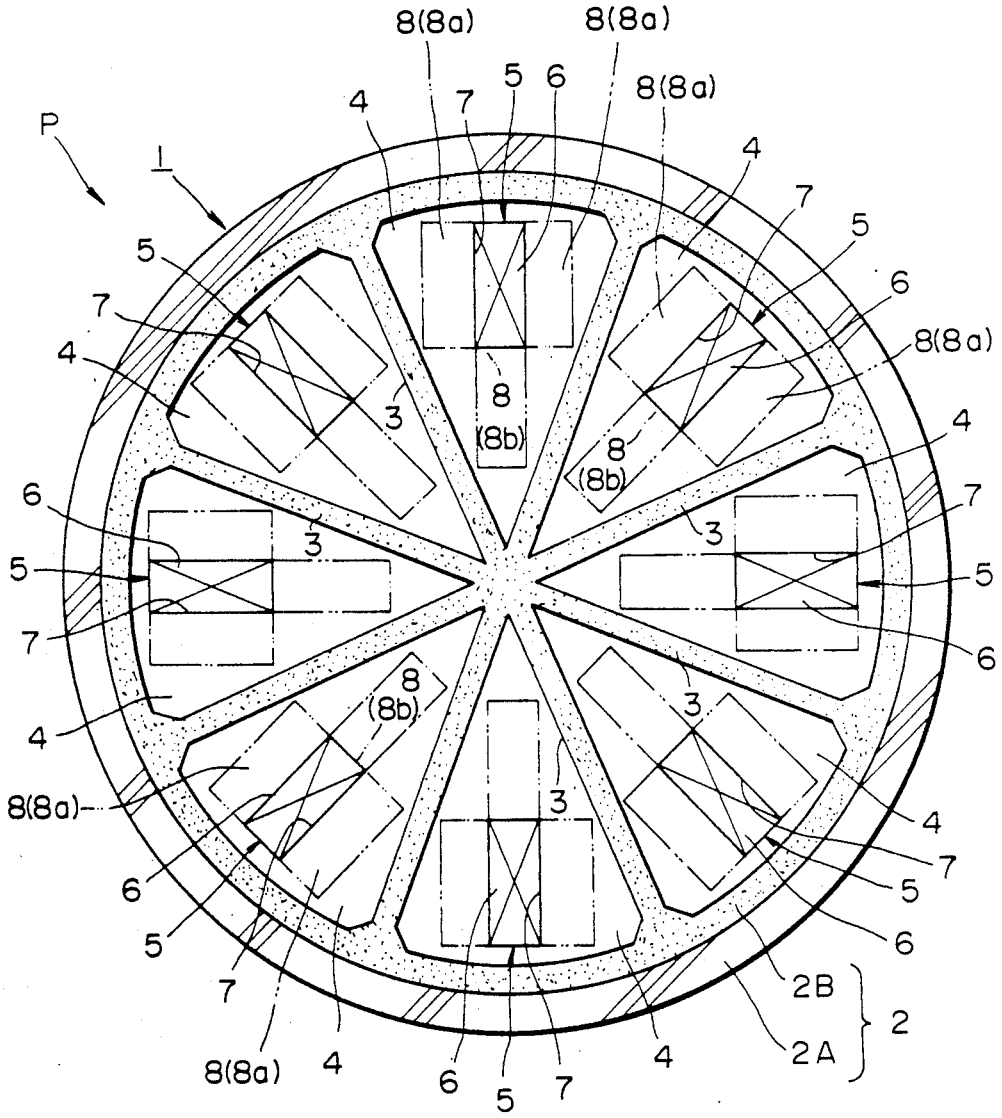
FIGS. 2 and 3 respectively show the underground parking lot according to the embodiment of the invention, FIG. 2 being a horizontal sectional view at a portion thereof, and FIG. 3 being a horizontal sectional view of the first floor portion thereof.
Figure 3:
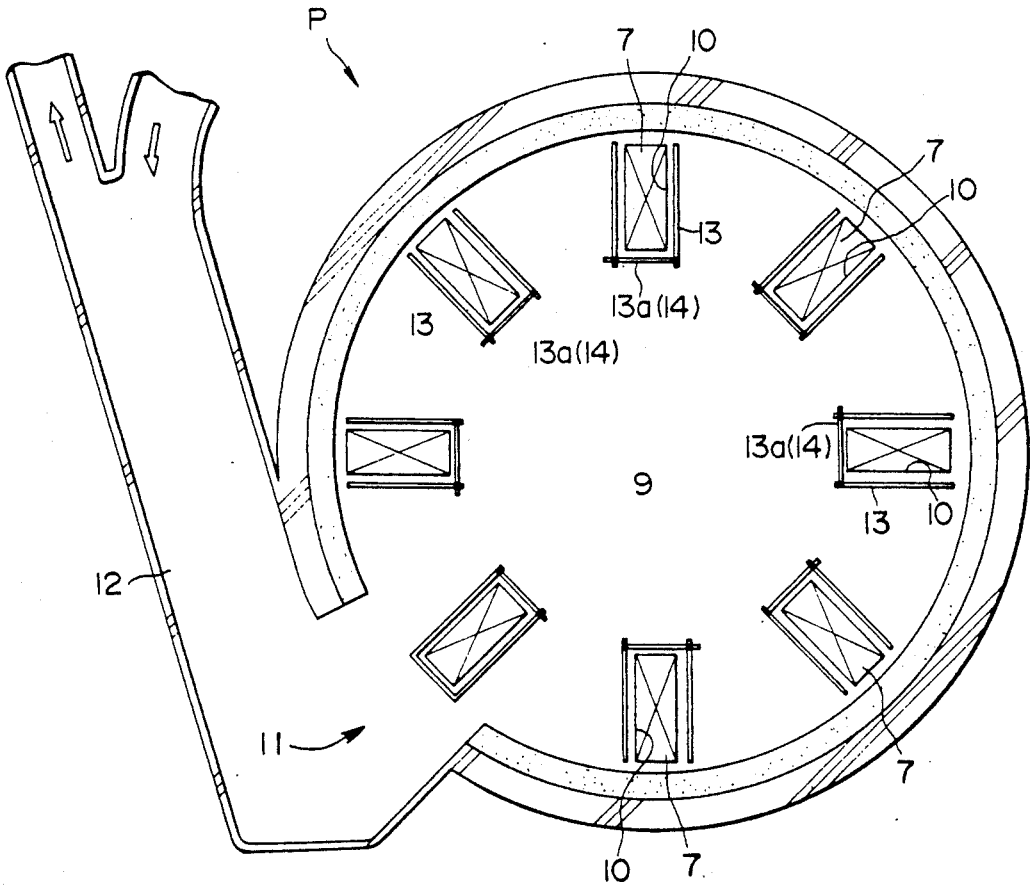

FIGS. 2 and 3 show a parking lot P which is constructed with the main body 1 having the essential structure as described above.

As shown in FIG. 2, vehicle accommodation mechanisms 5 are provided in the respective vehicle accommodation spaces 4. Each vehicle accommodation mechanism 5 is of elevator type and comprises a lift 6 for going up or down with a vehicle loaded thereon, and plural vehicle receiving stands 8 which are vertically arrayed close to a lift well 7 for the lift 6. Hitherto, as a vehicle accommodation mechanism of elevator type, there has already been provided the mechanism which has vehicle receiving stands vertically arrayed on both sides of a lift well, and in which a vehicle transported by a lift is transferred onto one of the receiving stands by moving the vehicle in a direction of width thereof. The vehicle accommodation mechanism 5 of the embodiment is further developed from the conventional mechanism, and is capable of transferring a vehicle from the lift 6 also in a longitudinal direction of the vehicle. Herein, the receiving stand disposed in the direction of width of a vehicle will be denoted by reference numeral 8*a*, while that disposed in the longitudinal direction of the vehicle will be designated by reference numeral 8*b*. In the embodiment, as shown in the drawing, only one row of receiving stands 8*b* are provided for every lift 6. These receiving stands 8*b* lie inside the well 7 for the lift 6, namely on the central side of the main body 1.

FIG. 3 shows the first floor portion of the parking lot P. The lift wells 7, which respectively constitute the eight vehicle accommodation mechanisms 5 in the vehicle accommodation spaces 4, open in this floor 9 to form vehicle inlets 10. That is, when each lift 6 goes uppermost, the top of the lift 6 comes to be flush with the floor 9 and closes the vehicle inlet 10 of the corresponding well. Reference numeral 11 designates an entrance to this parking lot P, which is formed in the wall of the first floor and connected with an entrance ramp 12.

Further, handrail-like protective fences are provided around the respective vehicle inlets 10 to prevent the vehicle entering the floor 9 from carelessly approaching the vehicle inlets 10 when the same are opened. Each protective fence 13 has, on the front side thereof, a horizontal bar 13*a* which is hinged at one end thereof for open and close and serves as a gate 14.

Subsequently, the operation of the underground parking lot P constructed as above will be described.

A user of this parking lot P drives along the entrance ramp 12 to the entrance 11, and enters the floor 9 of the parking lot P through the entrance 11.

The gate 14 of the protective fence 13 encircling each vehicle inlet 10 is kept released or opened when the corresponding lift 6 lies uppermost to close the vehicle inlet 10. The vehicle having entered the floor 9, therefore, can moves toward the vehicle inlet 10 corresponding to the opened gate 14 to get on the lift 6.

After the vehicle has been loaded on the lift 6, the lift is moved downward through the well 7. The lift 6 is automatically stopped at the position corresponding to empty one of the plural vehicle receiving stands 8 which are vertically arrayed along the well 7, and transfers the vehicle in a horizontal direction onto the aimed or empty vehicle receiving stand 8. Thus, the accommodation of the vehicle is completed.

Then, in case that there is no vehicle to leave the parking lot, the lift 6 is moved to its uppermost position to get ready for a next vehicle. When there is a vehicle to leave the parking lot, however, the lift 6 is moved to the position corresponding the vehicle receiving stand 8 where the vehicle to leave is accommodated. The lift 6 receives the vehicle, goes up to the uppermost position to carry the vehicle to the floor 9. The vehicle thus moved up to the floor 9, after the gate 14 has been opened, can run through the entrance 11 to the entrance ramp 12.

In the embodiment, as described above, the vehicle accommodation spaces 4 are formed of eight in number, and the vehicle accommodation mechanisms 5 are respectively provided in the vehicle accommodation spaces 4. Therefore, the above operation can be performed in every vehicle accommodation mechanism 5.

According to the above parking lot P, it is possible to effectively use the excellent main body 1 to the maximum extent and realize the increase in number of accommodated vehicles per area, namely the improvement of efficiency of accommodation for vehicles. Moreover, because the vehicle accommodation mechanisms 5 are provided in the respective vehicle accommodation spaces 4 and are respectively provided with the vehicle inlets 10 for taking in or delivering vehicles, the parking lot has a great capacity for handling vehicles. It is possible to prevent, to the best of its ability, a traffic jam from occurring due to plural vehicles waiting for their turns even when there are many vehicles to use the parking lot. Further, the structure for taking in vehicles can be made very simple, because the inlets 10 corresponding to the respective vehicle accommodation mechanisms 5 simply open in the floor 9.

Incidentally, although it is effective that the ground structure to be constructed on the underground parking lot P is in the same cylindrical shape as that of the main body 1, the ground structure may be formed in a rectangular shape. In this case, as the ground structure juts out from its foundation of the main body 1, it is necessary to provide piles or the like for supporting the portions of the ground structure jutting out of the foundation. Even in such case, however, because the main body 1 can be made larger in cross section than the main body of a conventional underground parking lot, piles or the like to be additionally provided can be reduced in number as few as possible. Therefore, it is possible to simplify the construction of additional foundation which is executed separately from the construction of the main body of the parking lot.

Further, in the above embodiment, the protective fence 13 with the gate 14 has been exemplified as means for securing the safety of vehicles entering the floor 9. However, the safety of the vehicles may be assured by other method and structure.

Figure 4:
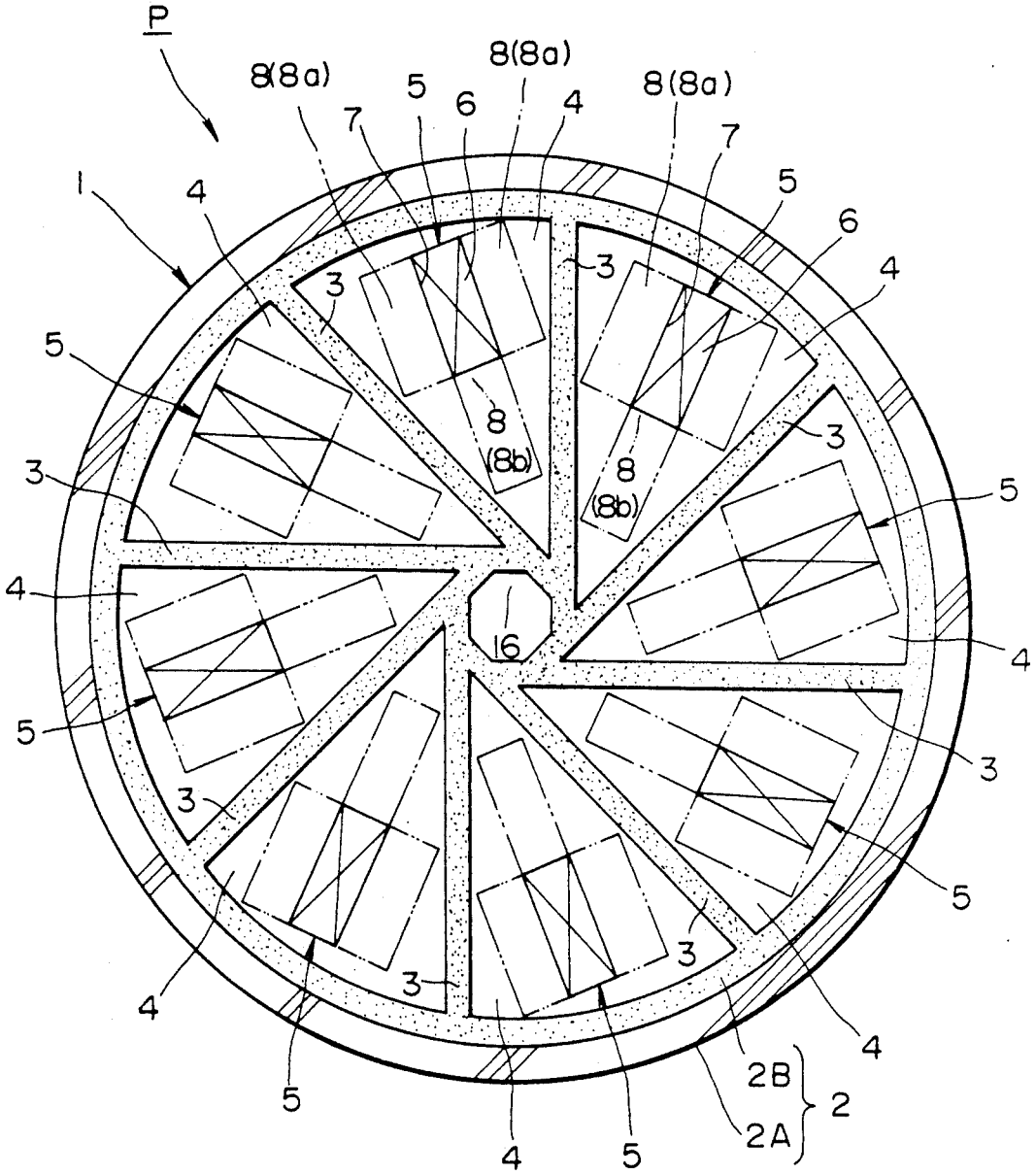
FIG. 4 shows the underground parking lot according to a second embodiment of the invention and is a horizontal sectional view at a portion thereof.

FIG. 4 shows the underground parking lot according to the second embodiment of the invention. In the following description, the constituent elements similar to those of the first embodiment will be designated by the same reference numerals, and description of such elements will be omitted.

In this embodiment, the main body 1 of the underground parking lot is substantially identical with that of the first embodiment except for radial partition walls g. These radial partition walls 3 are different from those of the first embodiment in that each partition wall is formed to extend not from the axial center of the cylinder defined by an outer wall 2 but from a position which is slightly deviated from the axial center.

That is, representing conversely to the above, each radial partition wall g is formed to inwardly extend from the inner side of the outer wall 2 in a direction which is slightly offset from a radial direction of the outer wall 2. With this formation, at an axial center portion of the outer wall 2, defined is a space 16 which is in a regular-octagonal shape in this embodiment. Besides, in the embodiment, the structure of an elevator type vehicle accommodation mechanism 5 and the function of the parking lot are the same as those of the first embodiment.

The main body 1 according to this embodiment functions similarly to the main body of the first embodiment, and is more useful in that the space 16 can be utilized, for instance, as a space for placement of pipes and cables of various equipments.

Figure 5:
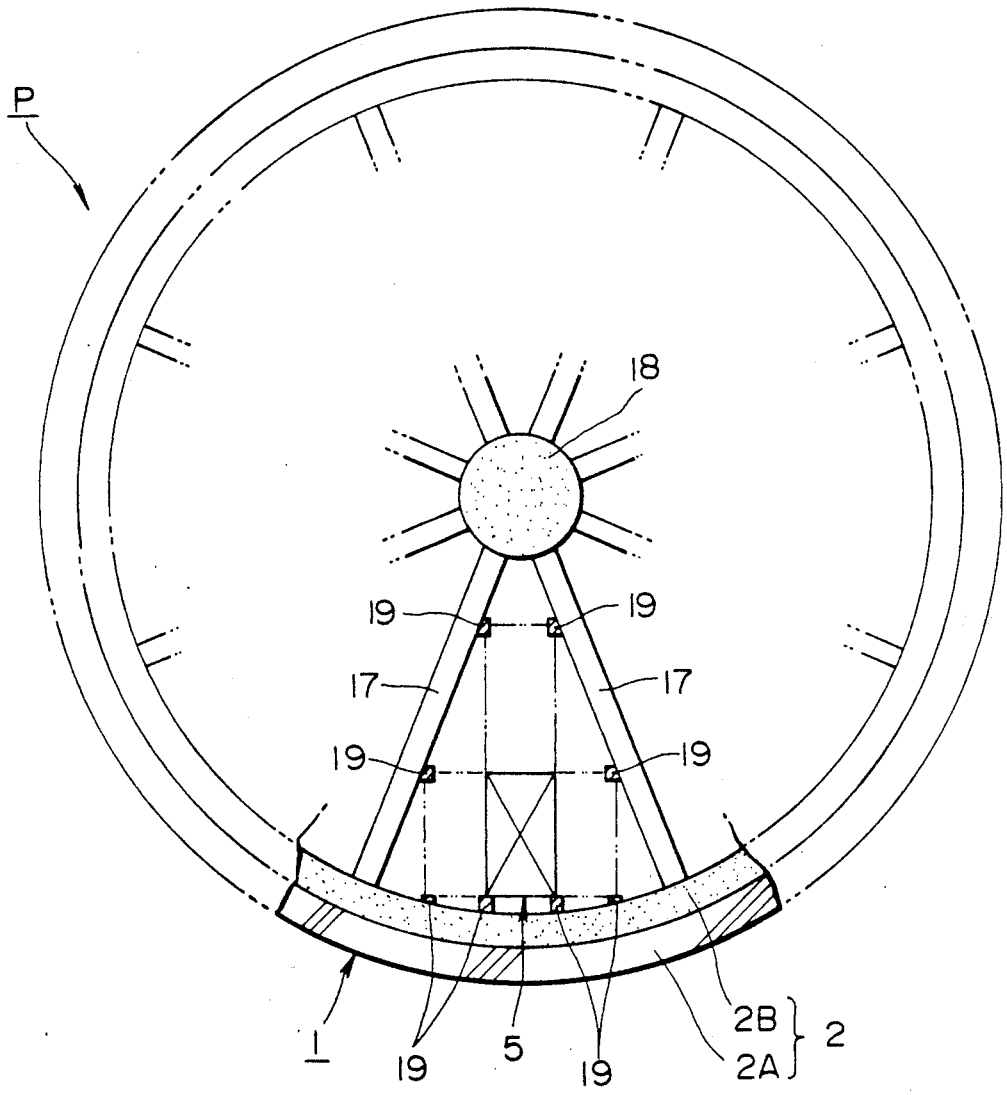
FIG. 5 shows the underground parking lot according to a third embodiment of the invention and is a horizontal sectional view at a portion thereof.

FIG. 5 shows the main body structure of the underground parking lot according to the third embodiment of the invention.

In the preceding two embodiments, the radial structural bodies have been constituted by the radial partition walls 3, respectively. In this embodiment, however, a radial structural body is constituted by beams 17. More particularly, the main body of this embodiment has a structure in which a pillar 18 is provided at the axial center of an outer wall 2 which is identical with those of the embodiments described above, and the beams 17 are respectively formed to radially extend from the pillar 18 to the outer wall 2. These radially extending beams 17 are in such arrangement that, with respect to each beam 17 shown in FIG. 5, a plurality of beams are arrayed in a vertical direction, or a direction of depth of the outer wall, and are adapted to cause no shift or difference in phase between adjacent beams in the circumferential direction of the outer wall. That is, when viewing the main body 1 from above, fan-shaped vehicle accommodation spaces 4 can be viewed as if they are completely defined from the top of the main body to the bottom thereof just as the main body 1 shown in FIG. 1.

Thus, in the main body 1 of the underground parking lot according to the invention, the radial structural body may also be constituted by beams or the like as is in case of this embodiment. In the case where the radial structural body is constituted not by walls but by beams, as the amount of concrete to be used is lessened, the construction may advantageous in cost.

Moreover, when the parking lot P is constructed with the main body 1 according to this embodiment, support members 19 which comprises brackets, pillars or the like may additionally be provided at predetermined positions on the respective beams 17 and the inside of the outer wall 2 as shown in FIG. 5. These support members 19 can serve to install vehicle accommodation mechanisms 5.

What is claimed is:

1. An underground parking lot comprising: an outer wall formed in a substantially cylindrical shape for defining a space under ground;

a radial structural body formed within and connected to said outer wall for dividing said space of said outer wall into plural vehicle accommodation spaces; and vehicle accommodation mechanisms respectively provided in said vehicle accommodation spaces, each vehicle accommodation mechanism including a lift for going up and down with a vehicle loaded thereon, a well for said lift, and plural vehicle receiving stands vertically arrayed close to said lift well.

2. The underground parking lot according to claim 1, wherein three rows of said vehicle receiving stands are provided for every lift well.

3. The underground parking lot according to claim 2, wherein two of said three rows are respectively arranged on both sides of every lift well with respect to a circumferential direction of said outer wall, and remaining one of said three rows is disposed on an inner side of every lift well with respect to a radial direction of said outer wall.

4. The underground parking lot according to claim 1, wherein a first floor is formed over said vehicle accommodation spaces, and said lift wells respectively opens in said first floor to form inlets for taking in and delivering vehicles.

5. The underground parking lot according to claim 4, wherein each of said lifts has a top on which a vehicle is loaded, and when each lift lies uppermost, said top of the lift is flush with said first floor to close the corresponding inlet and allow a vehicle to get on said lift.

6. The underground parking lot according to claim 5, wherein a protective fence is provided around every inlet to prevent a vehicle from approaching the inlet when the inlet is opened.

7. The underground parking lot according to claim 6, wherein said protective fence has a bar hinged thereto to constitute a gate for open and close, and said gate is kept open whenever the corresponding lift lies uppermost to close the corresponding inlet.

* * * * *